US007163377B2

(12) United States Patent
Blateri et al.

(10) Patent No.: US 7,163,377 B2
(45) Date of Patent: Jan. 16, 2007

(54) APPARATUS AND METHOD FOR MOUNTING A CEILING FIXTURE

(75) Inventors: Frank Blateri, Coppell, TX (US); Wang Liang Chou, Taichung (TW)

(73) Assignee: Diani, LLC., Dallas, TX (US)

( * ) Notice: Subject to any disclaimer, the term of this patent is extended or adjusted under 35 U.S.C. 154(b) by 207 days.

(21) Appl. No.: 10/962,853

(22) Filed: Oct. 12, 2004

(65) Prior Publication Data

US 2006/0078431 A1 Apr. 13, 2006

(51) Int. Cl.
*F04D 29/34* (2006.01)

(52) U.S. Cl. ..... 416/210 R

(58) Field of Classification Search ..... 416/5, 416/134 R, 204 R, 210 R, 214 R
See application file for complete search history.

(56) References Cited

U.S. PATENT DOCUMENTS 4,850,799 A * 7/1989 Bucher et al. ..... 416/134 R
D409,299 S 5/1999 Chou
5,967,754 A 10/1999 Chou
6,042,339 A 3/2000 Blateri et al.
6,139,276 A 10/2000 Blateri et al.
6,155,786 A 12/2000 Blateri et al.
6,210,117 B1 * 4/2001 Bucher et al. ..... 416/210 R
6,241,475 B1 6/2001 Blateri et al.
6,261,064 B1 7/2001 Tang
6,347,924 B1 2/2002 Chang
6,352,409 B1 3/2002 Blateri et al.
6,494,682 B1 12/2002 Blateri et al.
2001/0046442 A1 11/2001 Bucher et al.
2002/0054816 A1 5/2002 Bucher et al.

FOREIGN PATENT DOCUMENTS

EP 1 239 162 A1 9/2002

OTHER PUBLICATIONS

European Patent Office, "European Search Report," International Patent Application No. 05022206.6-2315, Dec. 22, 2005, 6 pages.

* cited by examiner

*Primary Examiner*—Edward K. Look
*Assistant Examiner*—Nathan Wiehe
(74) *Attorney, Agent, or Firm*—Haynes and Boone, LLP

(57) ABSTRACT

An apparatus and method for mounting a fixture to a ceiling according to which a tubular retainer extends in an opening of an arm and a fastener extends through the retainer and is retained by the retainer. The fastener is adapted to engage a device at the ceiling to mount the arm to the device.

10 Claims, 2 Drawing Sheets

APPARATUS AND METHOD FOR MOUNTING A CEILING FIXTURE

BACKGROUND OF THE INVENTION

The present invention relates to an assembly and method for mounting a fixture, such as a ceiling fan, to a ceiling, and, more particularly, to such an assembly and method in which the mounting is relatively easy and quick.

In a home or building, an installer often mounts a fixture, such as a ceiling fan or a light fixture, to a ceiling or other elevated area. In the case of a ceiling fan, for example, a plurality of arms are usually provided that connect a plurality of angularly-spaced blades to the casing, or housing, of an electric motor that is initially mounted to the ceiling. However, since the blades, arms and the motor are often packaged separately, they must be assembled and mounted at the site.

This assembly and mounting is relatively difficult and time-consuming especially since each blade must be attached to a corresponding arm, and each arm must be attached to the motor housing at an elevated position. Since there are usually five blades and arms, the labor costs involved constitute a high percentage of the overall cost of the assembly.

This is exacerbated by the fact that fasteners, usually in the form of threaded screws or bolts, are often used for attaching the arm to the motor housing, and must be inserted upwardly though openings in the arm and then threadedly engaged with the housing at the ceiling level. This usually requires the installer to be on a ladder, or the like, which makes it very difficult to hold the arm and the blade at the elevated position, insert the fasteners through the openings in the arm, and tighten the fasteners with a screw driving device. Moreover, since the arm is installed upside down, extra care has to be taken to ensure that the fasteners will not fall from the opening in the arm under the influence of gravity before they are fastened to the housing.

Therefore, what is needed is a fan assembly and a method of installing same in which the fan arms can be easily and quickly attached to the housing while eliminating the danger of the fasteners falling from the arm before they are tightened. The present invention addresses this need.

DETAILED DESCRIPTION

Figure 1:
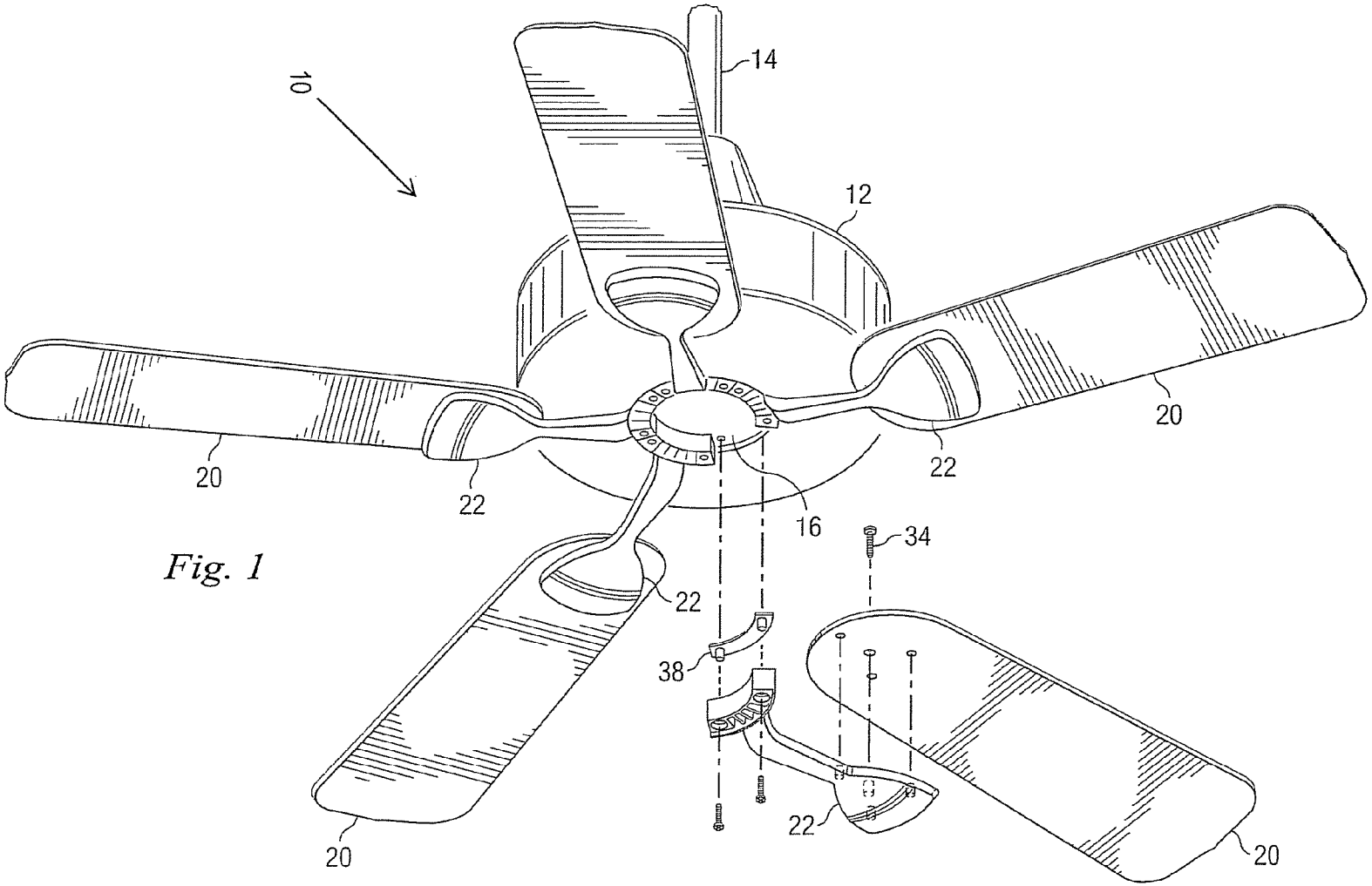
FIG. 1 is an isometric, partially exploded, view of an embodiment of the present invention.

FIG. 1 of the drawings depicts a fixture, in the form of a ceiling fan assembly 10 according to an embodiment of the present invention which includes a housing 12 containing a motor (not shown) and connected to a ceiling of a building by a downrod 14 that is mounted to the ceiling in any known manner. It is understood that electrical conductors extend from an electrical box (not shown) in the ceiling, through the rod, and into the interior of the housing 12 where they are connected to a conventional electrical motor. It is also understood that the motor contained in the housing 12 is conventional, and, as such, consists of a stator and a rotor that includes an end casing, a portion of which is exposed through an opening in the lower portion of the housing 12, and is referred to by the reference numeral 16.

Five elongated blades 20 are respectively mounted to the end portions of five mounting arms 22, and the mounting arms, in turn, are mounted to the housing 12. The details involving the connection of an arm 22 to the housing 12, and of a corresponding blade to each arm are better shown in FIG. 2.

In particular, each arm 22 includes a relatively wide and flat mounting portion 24 and a relatively flat necked-down portion 26, one end of which extends from the portion 24. The other end portion of the necked-down portion 26 is bent upwardly as viewed in the drawing, to form a portion 28, and an arcuate-shaped mounting flange 30 is formed at the end of the portion 28 and will be described in detail later.

An internally threaded post 24*a* and three guide pins 24*b* all extend from the upper surface of the arm portion 24. The corresponding end portion of each blade 20 has an enlarged opening 20*a* extending therethrough for receiving the post 24*a*, and three other openings 20*b* for receiving the corresponding guide pins 24*b*. An externally threaded fastener, or bolt, 34 extends through the opening 20*a* and threadedly engages the post 24*a* to retain the blade 20 to the arm 22.

Two externally threaded fasteners 36, which may be in the form of screws or bolts, are provided and extend through two spaced, through openings 30*a* in the mounting flange 30 for mounting the arm 26 to the lower surface of the end casing 16. To this end, a boot, or retainer, 38, having a cross section substantially the same as the corresponding cross section of the mounting flange 30 is provided, and is preferably fabricated from an elastic or resilient material, such as rubber. Two spaced tubular nipples 38*a* extend from the lower surface of the retainer 38, as viewed in FIG. 2. The spacing of the nipples 38*a* corresponds to the spacing of the openings 30*a* in the mounting flange 30, and the diameters of the nipples are slightly less than the diameter of the openings so that the nipples fit in the openings with minimum clearance.

The diameters of the threaded shank portions of each fastener 36 are slightly less than the diameters of the bore in the nipples 38*a* so that the fasteners extend through the bores of the nipples in a friction fit that is sufficient to retain the fasteners in the bores.

It is understood that the other arms 22 shown in FIG. 1 are identical to the arm 22 described above, and that a retainer and two fasteners, identical to the retainer 38 and the fasteners 36, are associated with each of the other arms.

Five pairs of spaced, internally threaded openings 16*a* are provide in the lower surface of the end casing 16 for receiving the fasteners 38 to mount the arm 24 to the end casing, in a manner to be described.

To mount the ceiling fan 10 to a ceiling, the rod 14 (FIG. 1) is mounted to the ceiling in any known manner, and the housing 12 is connected to the rod. The installer mounts each blade 20 to its corresponding arm 22 in the manner discussed above, and inserts a retainer 38 in the mounting flange 30 of each arm so that the retainer rests on the upper surface of the flange, with the nipples 38*a* extending in the openings 30*a* in the flange. Then, the fasteners 36 are inserted through the lower ends of the through openings 30*a* in the flange, as viewed in FIG. 2, with the respective shanks of the fasteners engaging the corresponding inner walls of the nipples 38*a* defining the bores of the nipples. The above-mentioned friction fits between the outer threaded surfaces of the fasteners 36 and the inner walls of the nipples 38 defining their bores and causing the fasteners to be retained in the flange 30.

This enables the installer to then climb a ladder or other elevated device and lift each assembly formed by the arm 22, the blade 20, the retainer 38 and the fasteners 36, assembled as described above, towards the lower surface of the end casing 16. Even though the fasteners 36 are facing downwardly from the lower ends of the openings 30*a*, and therefore would normally tend to fall from the openings due to gravity, they are retained in the openings by the retainer, as discussed above.

The installer can then align the openings 30*a*, and therefore the fasteners, 36 with the openings 16*a* in the end casing 16, and, using a screw driving device, drive the fasteners into a threaded engagement with the openings 16*a* to mount the arm 22, and therefore its corresponding blade 20, to the end casing.

Figure 2:
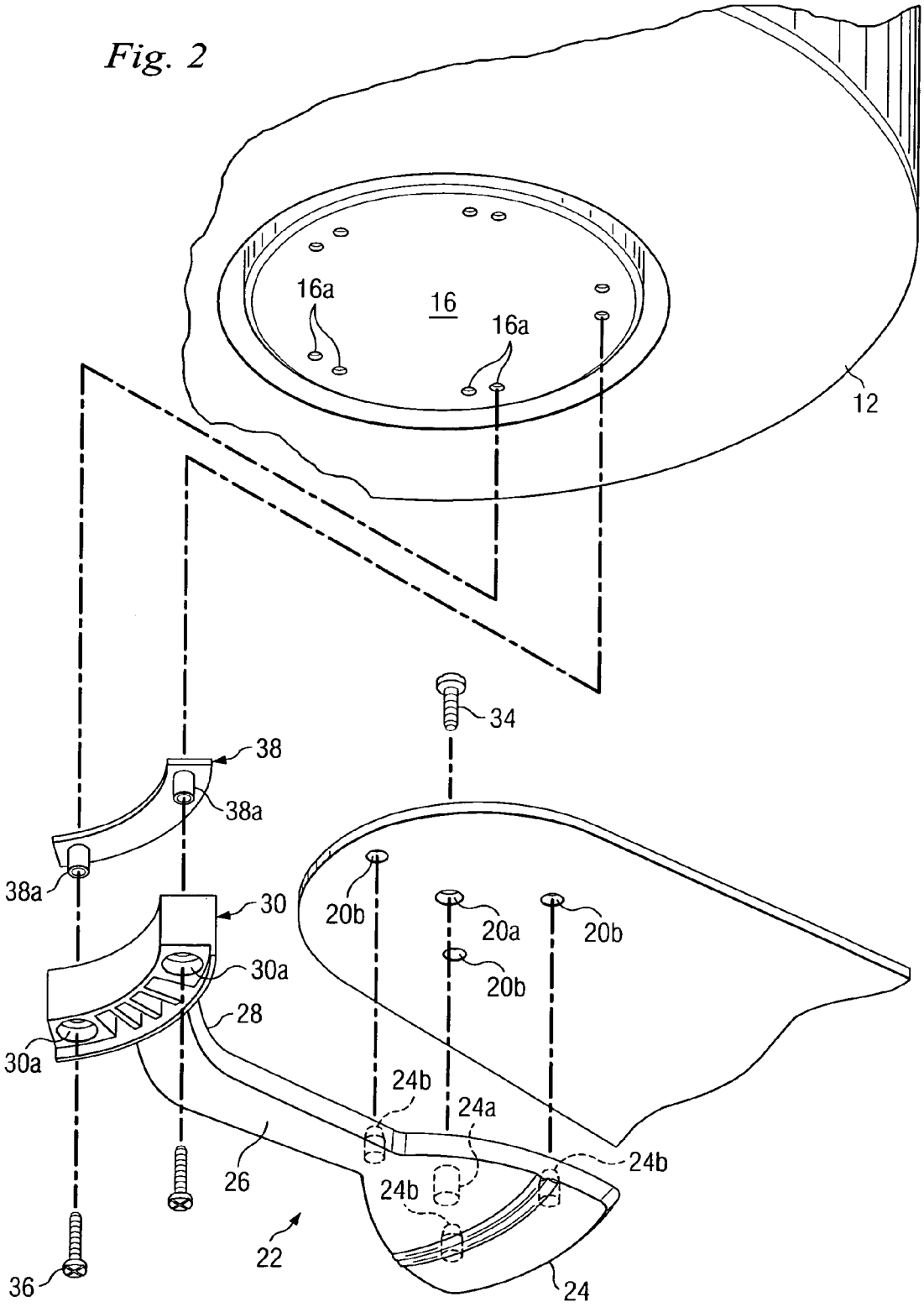
FIG. 2 is an enlarged, isometric, exploded view depicting components of the embodiment of FIG. 1.

Although only one arm 22, with its corresponding blade 20, are shown in FIG. 2, it is understood that the other blades and arms shown in FIG. 1 are mounted to the housing 12 in the same manner. Thus, the installer can mount each of all five assemblies formed by the arm 22, the blade 20, the retainer 38 and the fasteners 36, to the end casing 16 easily and quickly without having to cope with manually holding the fasteners in the openings 30*a* to keep them from falling from the latter openings, by gravity, before driving them into the openings 16*a*.

It is understood that variations may be made in the foregoing without departing from the scope of the invention, and examples of some variations are as follows.

(1) The number of blades 20, and therefore the number of arms and associated components discussed above, can vary within the scope of the invention.

(2) The number of openings 30*a* formed in the flange 30 and therefore the number of fasteners 36 associated with each flange, can be varied.

(3) The blades 20 can be mounted to the arms in a manner different from that described above.

(4) The arm portions 24, 26, 28, the flange 30, as well as the post 24*a* and the guide pins 24*b* can be molded integrally, or one or more of these components could be fabricated separately from the rest.

(5) The material forming the retainer 38 can be varied.

(6) The mounting flanges 30 can be connected to any part of the ceiling fan, other than the end casing.

(7) The above embodiment is not limited to ceiling fans, but is equally applicable to any installation in which it would be advantageous to utilize the retainer 38 in the manner discussed above.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A ceiling fan assembly comprising:

a device mounted on a ceiling;

at least one arm having at least one through opening;

a retainer mounted on the arm and comprising a tubular member extending in the opening and engaging the inner wall of the arm defining the opening in a friction fit;

a fastener extending through the opening and the tubular member and adapted to threadedly engage the device to mount the arm on the device;

the tubular member adapted to retain the fastener in the opening before the fastener threadedly engages the device to prevent the fastener from falling from the opening due to gravity; and a fan blade mounted on the arm.

2. The assembly of claim 1 wherein the retainer further comprises a body portion resting on the arm and formed integrally with the tubular member.

3. The assembly of claim 2 wherein the body portion rests on the upper surface of the arm and wherein the fastener is inserted from the lower portion of the arm into the opening and the tubular member.

4. The assembly of claim 1 wherein the fastener engages the bore of the tubular member in a friction fit.

5. The assembly of claim 4 wherein the fastener has an externally threaded shank, a portion of which engages the bore of the tubular member and another portion of which threadedly engages an internally threaded opening in the device.

6. The assembly of claim 1 wherein the tubular member retains the fastener in the opening when the assembly is being connected to the device.

7. The assembly of claim 1 wherein the arm includes a mounting flange, wherein there are two spaced openings extending through the mounting flange and two tubular members respectively extending in the openings and adapted to respectively receive and retain two fasteners.

8. The assembly of claim 1 wherein the tubular members retain the fasteners in the openings when the arms are being mounted on the device.

9. The assembly of claim 1 wherein the device is an end casing.

10. The assembly of claim 1 wherein there are a plurality of arms and wherein there is a retainer and a fan blade mounted on each arm.

* * * * *